US005931226A

United States Patent [19]

Hirano et al.

[11] Patent Number: 5,931,226

[45] **Date of Patent: *Aug. 3, 1999**

[54] REFRIGERANT TUBES FOR HEAT EXCHANGERS

[75] Inventors: Hirosaburo Hirano; Yuji Yamamoto; Shinji Ito, all of Tochigi, Japan

[73] Assignee: Showa Aluminum Corporation, Osaka, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/675,154

[22] Filed: Jul. 3, 1996

Related U.S. Application Data

[63] Continuation-in-part of application No. 08/618,090, Mar. 19, 1996, Pat. No. 5,638,897, which is a continuation of application No. 08/512,437, Aug. 8, 1995, abandoned, which is a continuation of application No. 08/077,069, Jun. 16, 1993, abandoned.

[30] Foreign Application Priority Data

Mar. 26, 1993 [JP] Japan ..... 5-068578

[51] Int. Cl.[6] ..... F28F 3/12

[52] U.S. Cl. ..... 165/170; 165/183

[58] Field of Search ..... 165/170, 181, 165/183

[56] References Cited

U.S. PATENT DOCUMENTS

| | | | |
|---|---|---|---|
| 2,151,540 | 3/1939 | Varga | 165/170 |
| 2,312,451 | 3/1943 | Strike . | |
| 2,571,631 | 10/1951 | Trumpler . | |
| 3,387,653 | 6/1968 | Coe . | |
| 3,457,990 | 7/1969 | Theophilos et al. | 165/133 |
| 3,528,496 | 9/1970 | Kun | 165/166 |
| 4,313,327 | 2/1982 | O'Connor . | |
| 4,688,311 | 8/1987 | Saperstein et al. . | |
| 4,805,693 | 2/1989 | Flessate | 165/179 X |
| 4,932,469 | 6/1990 | Beatenbough . | |
| 4,945,635 | 8/1990 | Nobusue et al. . | |
| 4,945,981 | 8/1990 | Joshi . | |
| 4,998,580 | 3/1991 | Guntly et al. . | |
| 5,078,207 | 1/1992 | Asano et al. . | |
| 5,172,476 | 12/1992 | Joshi | 29/890.53 |
| 5,184,672 | 2/1993 | Aoki . | |
| 5,185,925 | 2/1993 | Ryan et al. . | |
| 5,186,250 | 2/1993 | Ouchi et al. . | |
| 5,323,851 | 6/1994 | Abraham | 165/183 X |
| 5,372,188 | 12/1994 | Dudley et al. . | |
| 5,441,105 | 8/1995 | Brummett et al. | 165/170 X |
| 5,638,897 | 6/1997 | Hirano et al. | 165/170 X |

FOREIGN PATENT DOCUMENTS

| | | | |
|---|---|---|---|
| 0 283 937 | 9/1988 | European Pat. Off. . | |
| 338704 | 10/1989 | European Pat. Off. . | |
| 2209325 | 2/1972 | Germany . | |
| 37 30 117 | 6/1988 | Germany . | |
| 3 731 669 | 4/1989 | Germany . | |
| 98796 | 6/1982 | Japan . | |
| 105690 | 7/1982 | Japan | 165/183 |
| 136093 | 8/1982 | Japan . | |
| 174696 | 10/1982 | Japan . | |
| 98896 | 4/1989 | Japan . | |
| 164484 | 6/1993 | Japan | 165/183 |
| 332280 | 7/1930 | United Kingdom . | |
| 1 468 710 | 3/1977 | United Kingdom . | |
| 2 256 471 | 12/1992 | United Kingdom . | |

*Primary Examiner*—Leonard Leo
*Attorney, Agent, or Firm*—Armstrong, Westerman, Hattori, McLeland & Naughton

[57] ABSTRACT

A refrigerant tube for use in heat exchangers comprises a flat tube having parallel refrigerant passages in its interior and comprising upper and lower walls and a plurality of reinforcing walls connected between the upper and lower walls, the reinforcing walls extending longitudinally of the tube and spaced apart from one another by a predetermined distance. The reinforcing walls are each formed with a plurality of communication holes for causing the parallel refrigerant passages to communicate with one another therethrough. Each of the reinforcing walls is 10 to 40% in opening ratio which is the proportion of all the communication holes in the reinforcing wall to the reinforcing wall.

6 Claims, 11 Drawing Sheets

REFRIGERANT TUBES FOR HEAT EXCHANGERS

The present application, is a continuation-in-part of application Ser. No. 08/618,090, filed Mar. 19, 1996, now U.S. Pat. No. 5,638,897 which is a continuation of application Ser. No. 08/512.437, filed Aug. 8, 1995, abandoned, which is a continuation of application Ser. No. 08/077/069, filed Jun. 16, 1993, abandoned and relates to tubes for passing a refrigerant therethrough, i.e., refrigerant tubes, for heat exchangers, and more particularly to refrigerant tubes for condensers and evaporators for use in air-cooling systems for motor vehicles.

BACKGROUND OF THE INVENTION

The term "aluminum" as used herein and in the claims includes pure aluminum and aluminum alloys.

JP-B-45300/1991 discloses a condenser for use in air-cooling systems for motor vehicles which comprises a pair of headers arranged at right and left in parallel and spaced apart from each other, parallel flat refrigerant tubes each joined at its opposite ends to the two headers, corrugated fins arranged in air flow clearances between the adjacent refrigerant tubes and brazed to the adjacent refrigerant tubes, an inlet pipe connected to the upper end of the left header, an outlet pipe connected to the lower end of the right header, a left partition provided inside the left header and positioned above the midportion thereof, and a right partition provided inside the right header and positioned below the midportion thereof, the number of refrigerant tubes between the inlet pipe and the left partition, the number of refrigerant tubes between the left partition and the right partition and the number of refrigerant tubes between the right partition and the outlet pipe decreasing from above downward. A refrigerant flowing into the inlet pipe in a vapor phase flows zigzag through the condenser before flowing out from the outlet pipe in a liquid phase. Condensers of the construction described are called parallel flow or multiflow condenser, realize higher efficiencies, lower pressure losses and super-compactness and are in wide use recently in place of conventional serpentine condensers.

It is required that the flat refrigerant tube for use in the condenser have pressure resistance since the refrigerant is introduced thereinto in the form of a gas of high pressure. To meet this requirement and to achieve a high heat exchange efficiency, the refrigerant tube used is in the form of a flat aluminum tube which comprises upper and lower walls, and a reinforcing wall connected between the upper and lower walls and extending longitudinally.

However, the reinforcing wall provided in the refrigerant tube forms independent parallel refrigerant passages in the interior of the tube. Air flows orthogonal to the parallel refrigerant passages, so that the heat exchange efficiency is consequently higher in the refrigerant passage at the air inlet side than in the passage at the air outlet side. Accordingly, gaseous refrigerant is rapidly condensed to a liquid in the refrigerant passage at the upstream side, whereas the refrigerant still remains in the passage at the downstream side. When the entire structure of the tube is considered, the refrigerant therefore flows unevenly, failing to achieve a high heat exchange efficiency.

The object of the present invention is to provide a refrigerant tube for use in heat exchangers which achieves a high heat exchange efficiency.

SUMMARY OF THE INVENTION

The present invention provides a refrigerant tube which fulfills the above object and which comprises a flat tube having parallel refrigerant passages in its interior and comprising upper and lower walls and a plurality of reinforcing walls connected between the upper and lower walls, the reinforcing walls extending longitudinally of the tube and spaced apart from one another by a predetermined distance, the reinfocing walls being each formed with a plurality of communication holes for causing the parallel refrigerant passages to communicate with one another therethrough, each of the reinforcing walls being 10 to 40% in opening ratio which is the proportion of all the communication holes in the reinforcing wall to the reinforcing wall.

The refrigerant to be passed through the parallel refrigerant passages flows through the communication holes widthwise of the tube to spread to every part of all the passages, whereby portions of the refrigerant become mixed together. Accordingly no temperature difference occurs in the refrigerant between the passages, with the result that the refrigerant undergoes condensation at the upstream side and at the downstream side alike, flowing uniformly to achieve an improved heat exchange efficiency. The opening ratio which is the proportion of all the communication holes in the reinforcing wall to this wall influences thermal conductance. When within the range of 10 to 40%, the opening ratio results in satisfactory thermal conductance, whereby the heat exchange efficiency of the refrigerant tube can be further improved. The opening ratio is limited to the range of 10 to 40% because if the ratio is less than 10%, the thermal conductance does not increase and further because the conductance no longer increases even if the ratio exceeds 40%, entailing an increase only in coefficient of friction. The opening ratio in the range of 10 to 40% is preferably 10 to 30%, more preferably about 20%.

The communication holes are so sized in cross section as to permit the refrigerant to smoothly flow therethrough between the adjacent passages, to be free of the likelihood of becoming clogged with a flow of solder during brazing and to in no way impair the pressure resistance of the tube. The pitch of the communication holes is such that the holes will not lower the pressure resistance of the tube while permitting the refrigerant to smoothly flow across the reinforcing walls.

The communication holes formed in the plurality of reinforcing walls are preferably in a staggered arrangement when seen from above.

The pitch of the reinforcing walls in the widthwise direction of the tube is preferably up to 4 mm. A lower heat exchange efficiency will result if the pitch is in excess of 4 mm.

The height of the reinforcing walls is preferably up to 2 mm. If the wall height is over 2 mm, not only difficulty is encountered in fabricating a compacted heat exchanger, but the resistance to the passage of air also increases to result in an impaired heat exchange efficiency.

The present invention will be described in greater detail with reference to the accompanying drawings.

DESCRIPTION OF THE PREFERRED EMBODIMENTS

Figure 19:
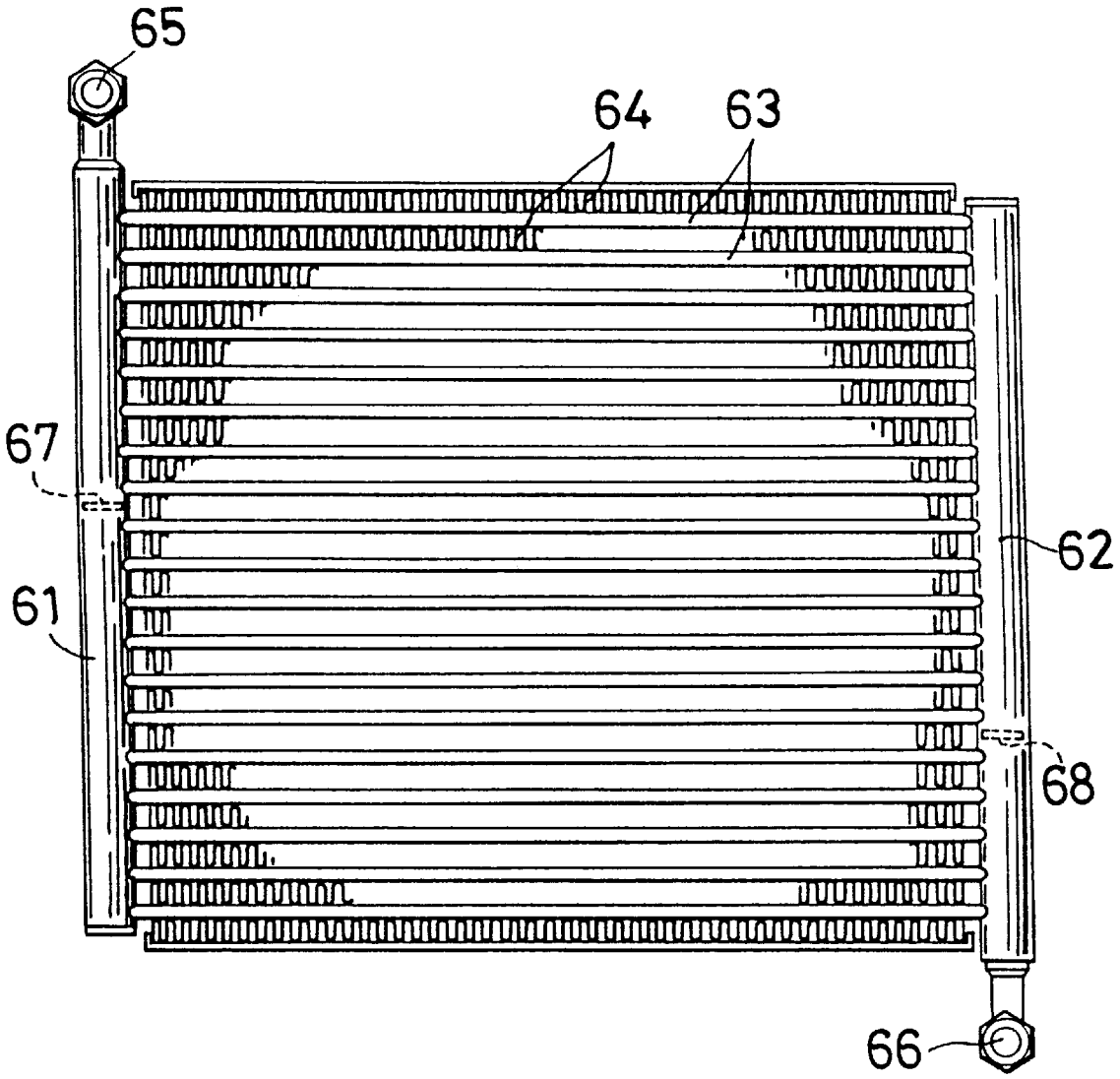
FIG. 19 is a front view showing a condenser wherein flat refrigerant tubes are used.

FIG. 19 shows a condenser comprising flat refrigerant tubes embodying the invention. The condenser comprises a pair of headers 61, 62 arranged at left and right in parallel and spaced apart from each other, parallel flat refrigerant tubes 63 each joined at its opposite ends to the two headers 61, 62, corrugated fins 64 arranged in air flow clearances between the adjacent refrigerant tubes 63 and brazed to the adjacent refrigerant tubes 63, an inlet pipe 65 connected to the upper end of the left header 61, an outlet pipe 66 connected to the lower end of the right 62, a left partition 67 provided inside the left header 61 and positioned above the midportion thereof, and a right partition 68 provided inside the right header 62 and positioned below the midportion thereof, the number of refrigerant tubes 63 between the inlet pipe 65 and the left partition 67, the number of refrigerant tubes 63 between the left partition 67 and the right partition 68 and the number of regrigerant tubes 63 between the right partition 68 and the outlet pipe 66 decreasing in this order. A refrigerant flowing into the inlet pipe 65 in a gas phase flows zigzag through the condenser before flowing out from the outlet pipe 66 in a liquid phase.

The refrigerant tubes 63 for use in the above condenser are concerned with the present invention. Refrigerant tubes embodying the invention will be described below. The following embodiments are all 10 to 40% in opening ratio which is the proportion of all communication holes in each reinforcing wall to the reinforcing wall. The communication holes formed in a plurality of reinforcing walls are all in a staggered arrangement.

Embodiiment 1

Figure 1:
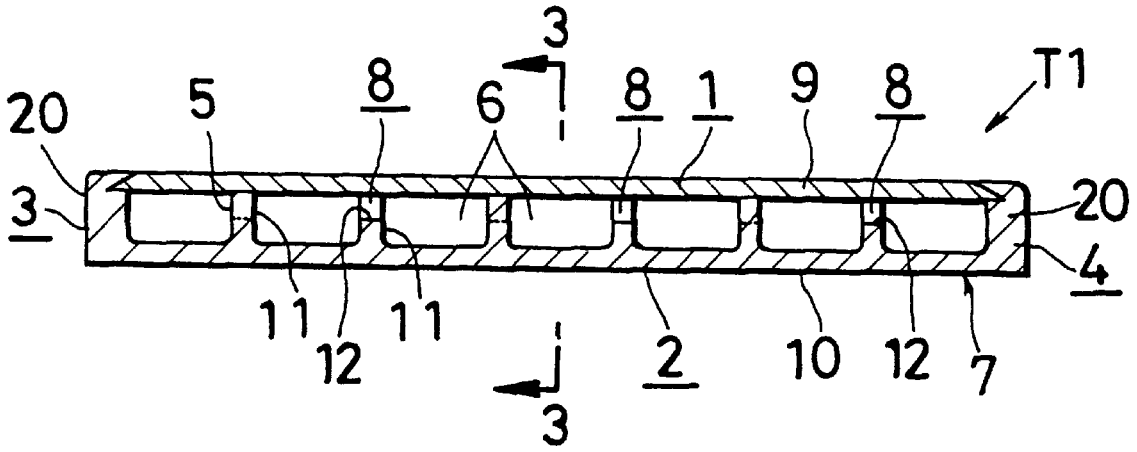
FIG. 1 is a view in cross section showing a flat refrigerant tube of Embodiment 1 of the present invention.
Figure 2:
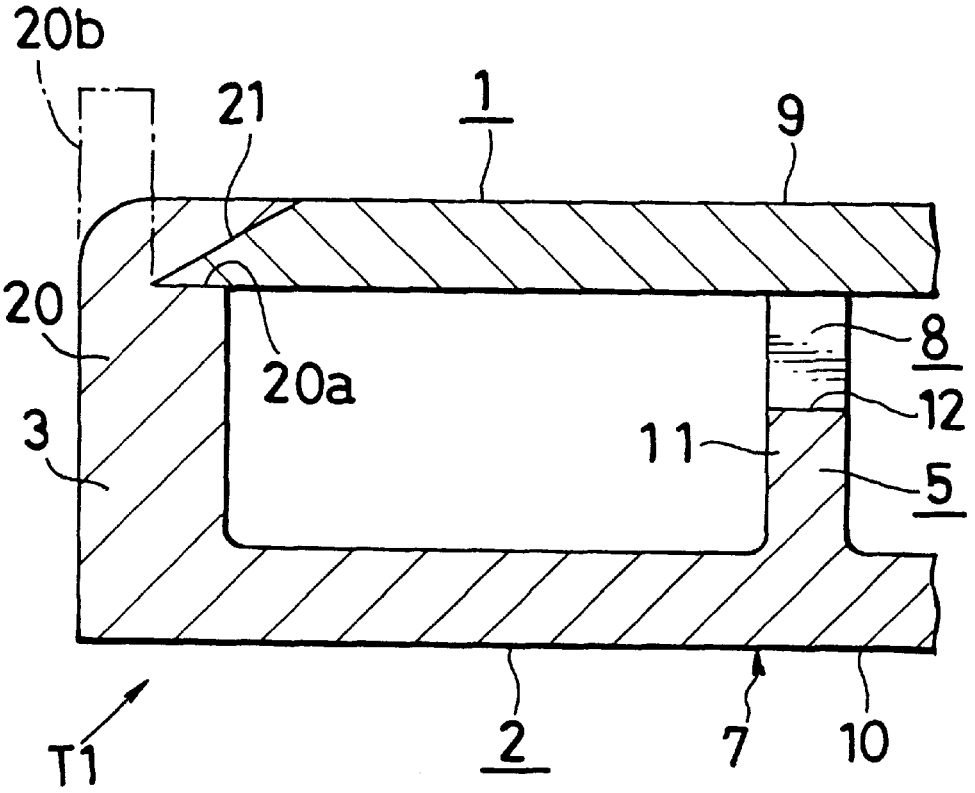
FIG. 2 is an enlarged fragmentary view of the tube shown in FIG. 1.
Figure 3:
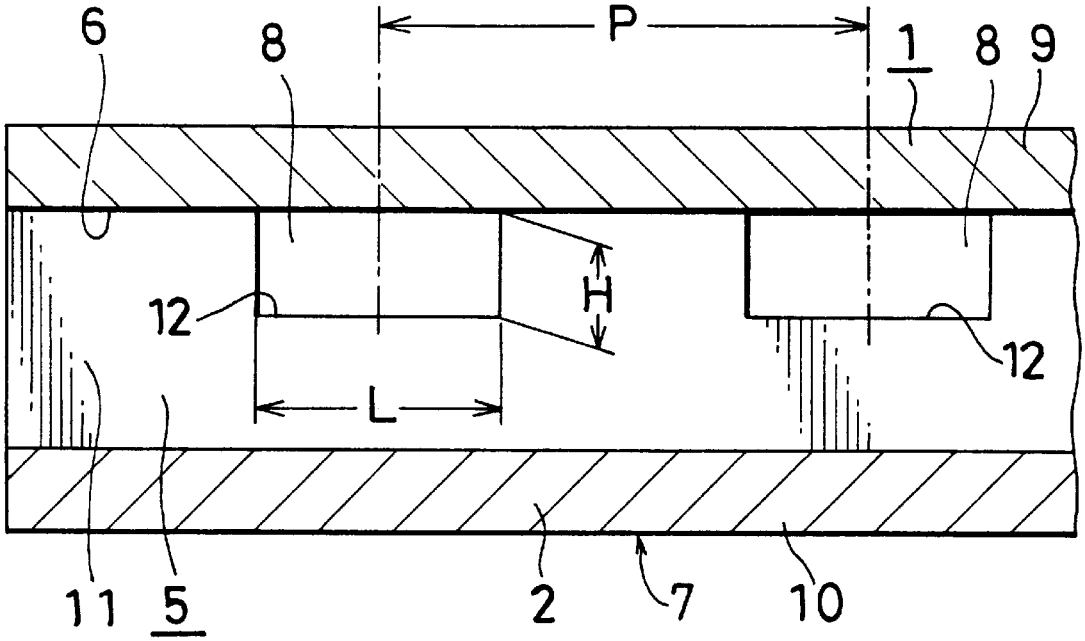
FIG. 3 is an enlarged view in section taken along the line 3—3 in FIG. 1.

This embodiment is shown in FIGS. 1 to 3. A refrigerant tube T1 for heat exchangers is formed by a flat aluminum tube 7 having parallel refrigerant passages 6 in its interior and comprising flat upper and lower walls 1, 2, left and right vertical side walls 3, 4 connected respectively between the left side edges of the upper and lower walls 1, 2 and between the right side edges thereof, and a plurality of reinforcing walls 5 connected between the upper and lower walls 1, 2, extending longitudinally of the tube and spaced apart from one another by a predetermined distance. The reinforcing walls 5 are each formed with a plurality of rectangular communication holes 8 for causing the parallel refrigerant passages 6 to communicate with each other therethrough, The flat aluminum tube 7 is prepared from upper and lower two aluminum sheets 9, 10 by vertically bending the lower sheet 10 at its opposite side edges, joining the bent side edges to the respective side edges of the upper aluminum sheet 9 so as to define a hollow portion by the two aluminum sheets 9, 10.

The reinforcing walls 5 are formed by parallel ridges 11 projecting inward from the lower wall 2 and joined to the inner surface of the upper wall 1. The rectangular communication holes 8 are formed by rectangular cutouts 12 provided in the upper edge of each ridge 11 at a predetermined spacing and having their openings closed by the upper wall 1.

The refrigerant tube T1 is produced by the following method.

Figure 4:
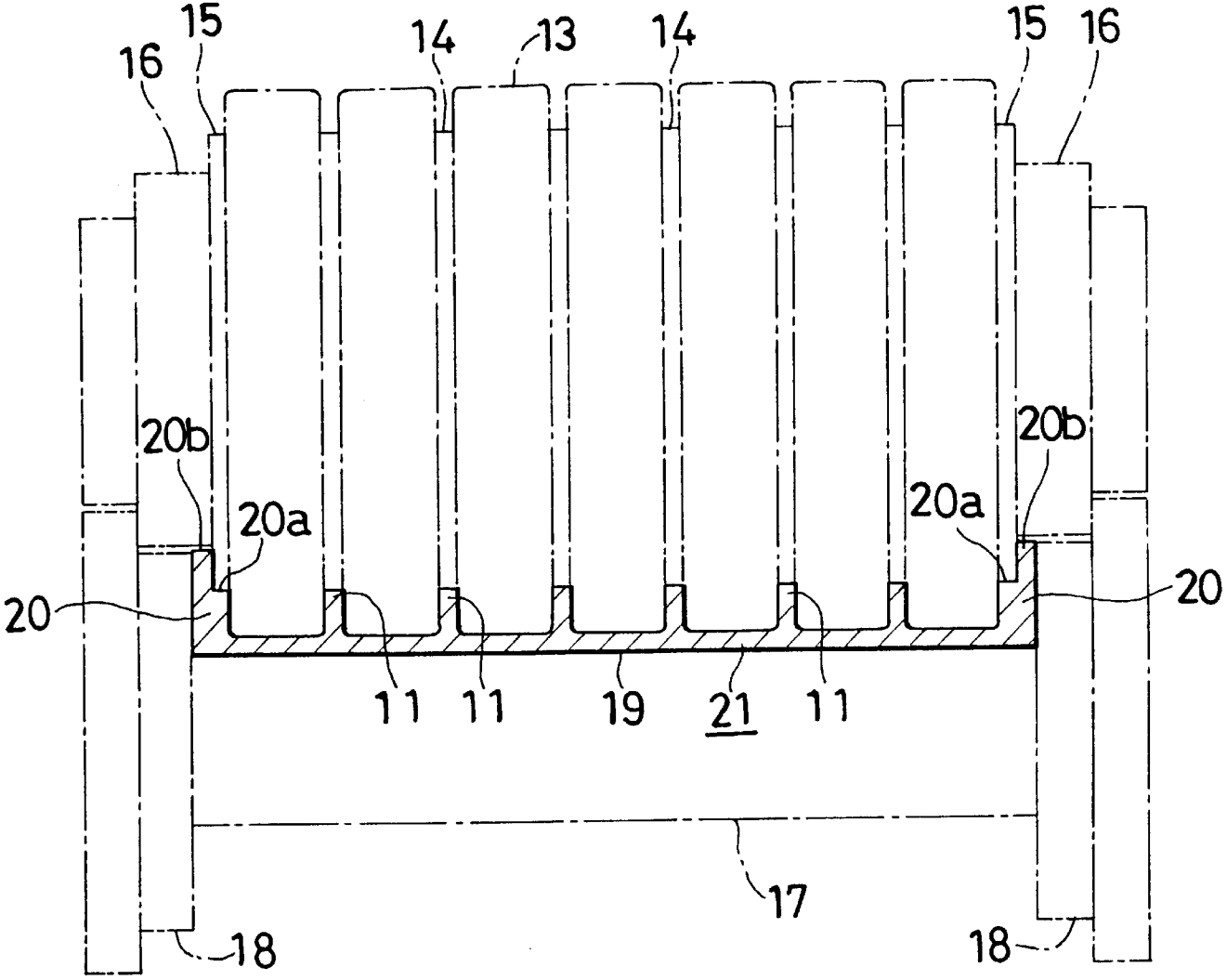
FIG. 4 is a cross sectional view showing how to produce an aluminum sheet by rolling for fabricating the refrigerant tube of Embodiment 1 of the invention.

With reference to FIG. 4, an aluminum sheet blank in the form of a brazing sheet covered with a brazing filler metal over the lower surface and having a thickness greater than that of upper and lower walls of the refrigerant tube to be produced is first rolled by a pair of upper and lower rolls 13, 17. The upper roll 13 has parallel annular grooves 14 arranged at a spacing, first small-diameter portions 15 formed at the respective outer sides of the arrangement of grooves 14 and each having a periphery of the same diameter as the bottom faces of the grooves 14, and second small-diameter portions 16 positioned externally of the respective first small-diameter portions 15 and having a smaller diameter and a greater width than the portions 15. The lower roll 17 is provided, at its respective outer ends, with large-diameter portions 18 each having an outer end face flush with that of the second small-diameter portion 16 and having a smaller width than the portion 16. The peripheral surfaces of the rolling rolls 13, 17 form a flat portion 19 providing the lower wall 2 by thinning the sheet blank to a specified thickness. The rolls 13, 17 also form ridges 11 projecting from the flat portion 19 integrally therewith by means of the annular grooves 14. Further formed at the respective side edges of the flat portion 19 are upright portions 20 each including an inner stepped part 20*a* with the same height as the ridges 11, and a thin wall 20*b* extending upward from the outer edge of the stepped part 20*a*. Thus, the rolling operation produces a rolled aluminum sheet 21.

Figure 5:
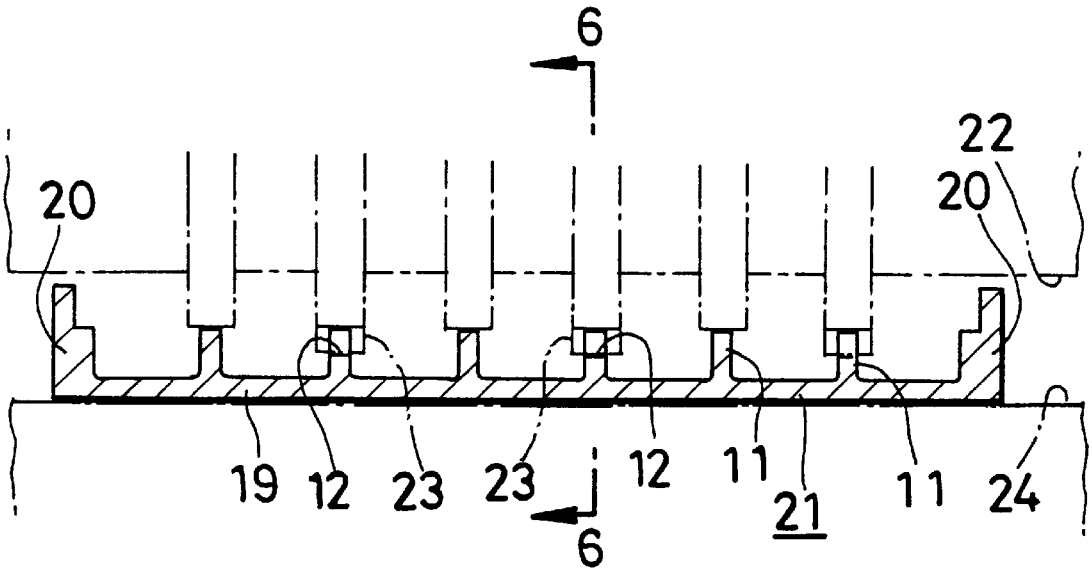
FIG. 5 is a cross sectional view showing how to form cutouts in the upper edges of ridges of the aluminum sheet shown in FIG. 4.
Figure 6:
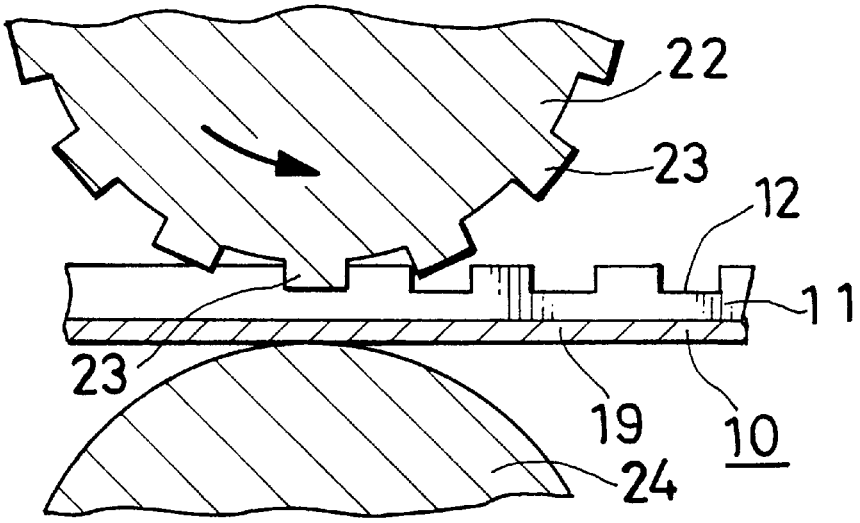
FIG. 6 is a view in section taken along the line 6—6 in FIG. 5.

As shown in FIGS. 5 and 6, the rolled aluminum sheet 21 is then passed between a pair of upper and lower rolls 22, 24. The upper roll 22 has rectangular protrusions 23 arranged at a predetermined spacing at a position corresponding to each of the parallel annular grooves 14 in the upper roll 13 for the preceding step. This rolling operation forms rectangular cutouts 12 in the upper edges of the respective ridges 11 at the predetermined spacing, whereby the lower aluminum sheet 10 is obtained.

The multiplicity of protrusions 23 are in a staggered arrangement so that the cutouts 12 are formed in the upper edges of the parallel ridges 11 in a staggered arrangement when seen from above.

Figure 7:
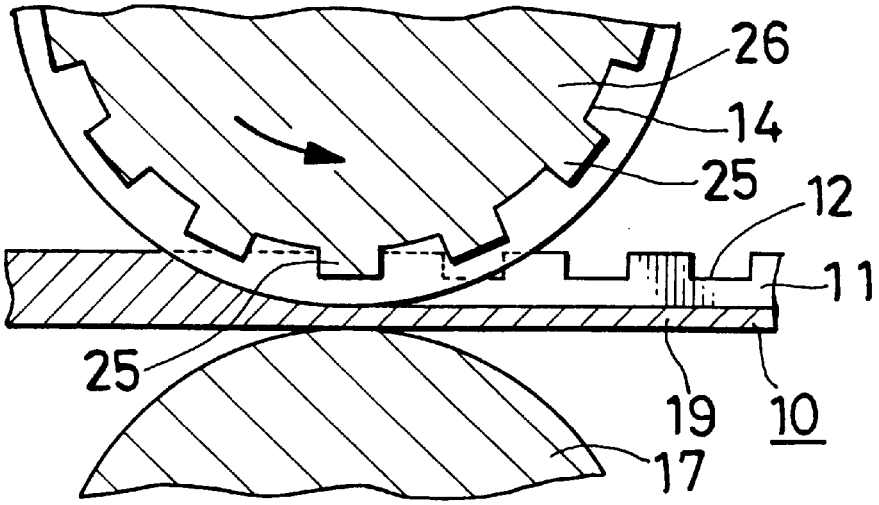
FIG. 7 is a view in longitudinal section showing how to form the ridges and the cutouts in the upper edges thereof by a single step.

The above method of producing the lower aluminum sheet 10 requires two steps for forming the ridges 11 having the cutouts 12. As shown in FIG. 7, however, these ridges 11 with the cutouts 12 can be formed by a single step by using in combination with the lower roller 17 of the first step an upper roll 26 which is formed in each of parallel annular grooves 14 with protrusions 25 arranged at a predetermined spacing and having a height smaller than the depth of the grooves.

Figure 8:
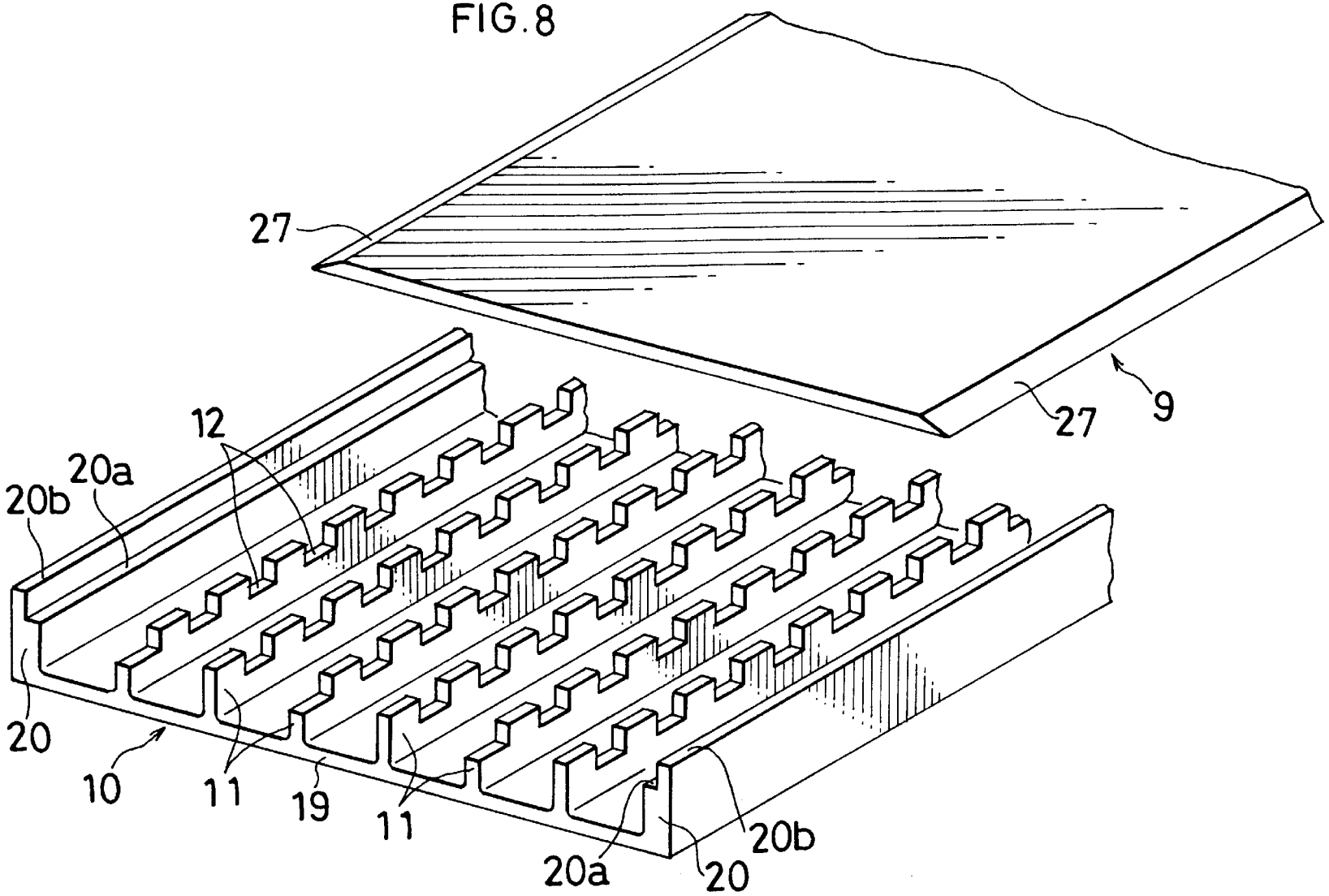
FIG. 8 is an enlarged fragmentary perspective view showing the refrigerant tube of Embodiment 1 of the invention while it is being fabricated.

On the other hand, the flat upper aluminum sheet 9 is prepared which comprises a brazing sheet having opposite surfaces each covered with a brazing filler metal layer. As seen in FIG. 8, the upper aluminum sheet 9 has at each of its opposite side edge portions an upper surface in the form of a slope 27 slanting outwardly downward. With reference to FIG. 2, each side edge portion of the upper aluminum sheet 9 is placed on the stepped part 20*a* of the upright portion 20 of the lower aluminum sheet 10, and the thin wall 20*b* (indicated in a broken line) is crimped onto the slope 27 of the upper aluminum sheet 9. Subsequently, the lower surface of the upper sheet 9 is brazed to the stepped parts 20*a* of the upright portions 20 of the lower sheet 10 and to the top ends of the ridges 11 thereof, whereby the refrigerant tube T1 is fabricated.

The peripheral surface of the upper rolling roll 13 may be formed with indentations and projections which are triangular wavelike in cross section, or knurled. The lower aluminum sheet 10 then obtained has projections and indentations extending longitudinally thereof over the entire inner surface, or has an inner surface formed with latticelike projections or indentations. This gives an increased surface area to the lower wall 2.

Embodiment 2

Figure 9:
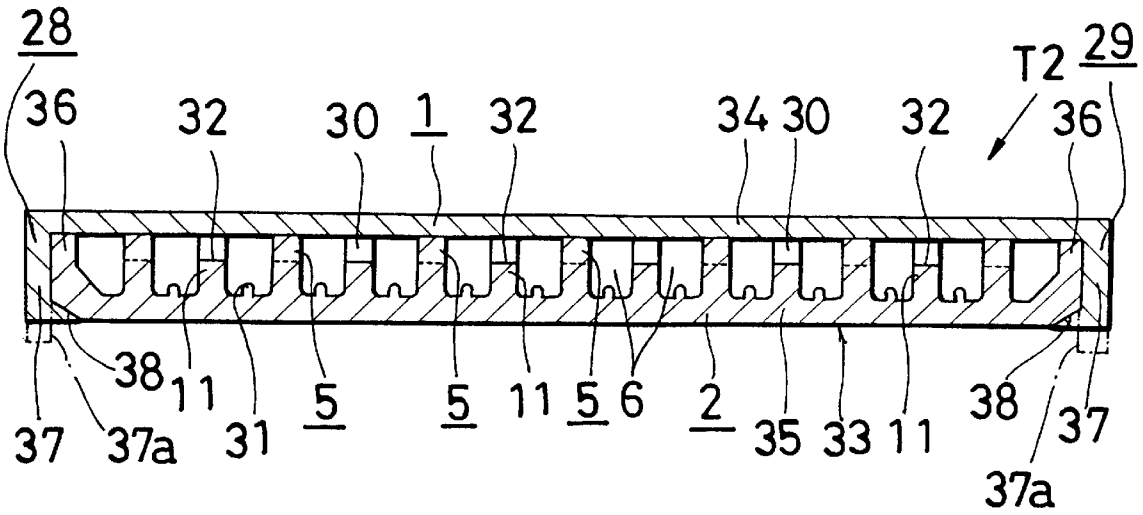
FIG. 9 is a cross sectional view of a flat refrigerant tube according to Embodiment 2 of the invention.

FIG. 9 shows this embodiment, i.e., a refrigerant tube T2 for use in heat exchangers. The tube T2 has the same construction as Embodiment 1 except that the tube T2 has left and right side walls 28, 29 of double structure, communication holes 30 in the form of an inverted trapezoid,and a plurality of relatively low upward projections 31 integral with the lower wall 2, extending longitudinally thereof and spaced apart from one another for giving a heat transfer surface of increased area. The holes 30 can be provided by forming trapezoidal cutouts 32 in the upper edges of the ridges 11.

The tube T2 comprises a flat aluminum tube 33, which is prepared by bending opposite side edges of upper and lower two aluminum sheets 34, 35, fitting the bent side edges of one of the two aluminum sheets 34, 35 respectively over the bent side edges of the other aluminum sheet and joining the fitted portions so as to define a hollow portion by the sheets 34, 35.

Stated more specifically, the side walls 28, 29 are formed by the following method. Upright portions 36 having the same height as the reinforcing walls 5 are provided respectively at opposite sides of the lower aluminum sheet 35, and a slope 38 slanting outwardly upward is formed at the bottom edge of each upright portion 36. As indicated in a broken line in FIG. 9, on the other hand, a depending portion 37 is formed at each of opposite sides of the upper aluminum sheet 34, the portion 37 being in contact with with the outer side face of the upright portion 36 and projecting downward slightly beyond the lower surface of the lower wall 2. The downward projections 37*a* of the depending portions 37 are crimped onto the respective slopes 38 of the lower aluminum sheet 35, and the portions where the upper and lower aluminum sheets 34, 35 are in contact with each other are brazed.

Embodiment 3

Figure 10:
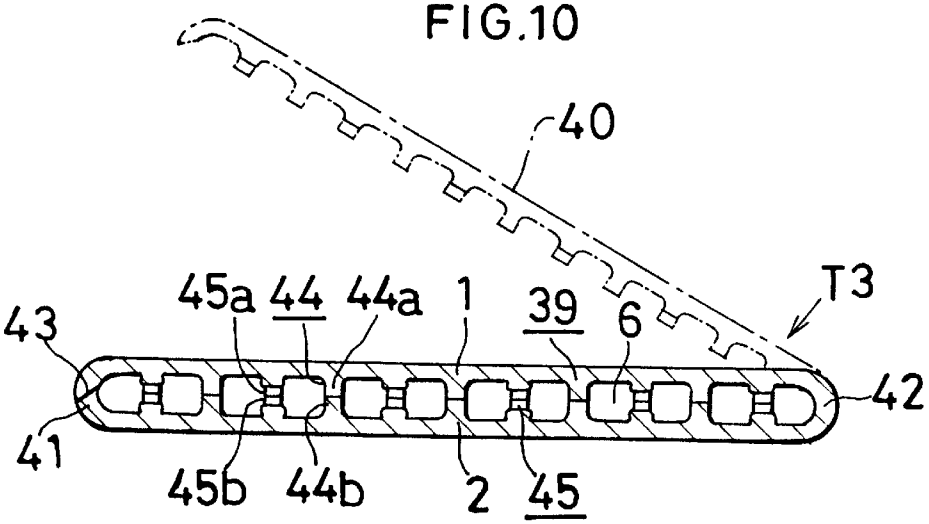
FIG. 10 is a cross sectional view of a flat refrigerant tube according to Embodiment 3 of the invention.

FIG. 10 shows this embodiment, i.e., a refrigerant tube T3 for use in heat exchangers, which comprises a flat aluminum tube 39. The tube 39 is prepared from an aluminum sheet 40 in the form of a brazing sheet having a brazing filler metal layer on one surface thereof, by folding the sheet at the midportion of its width like a hairpin with the brazing layer out so as to form a hollow portion, bending opposite side edges to an arcuate shape and joining the side edges in butting contact with each other. The tube 39 therefore has circular-arc left and right side walls 41, 42. The butt joint 43 thus made is oblique in cross section so as to form the joint 43 over an increased area.

Each of reinforcing walls 44 is formed by joining a downward ridge 44*a* inwardly projecting from the upper wall 1 to an upward ridge 44*b* inwardly projecting from the lower wall 2. Each of trapezoidal communication holes 5 is formed by the combination of a pair of trapezoidal cutouts 45*a*, 45*b*. Such cutouts 45*a*, 45*b* are formed respectively in the lower edge of the downward ridge 44*a* and the upper edge of the upward ridge 44*b* at a predetermined spacing.

Embodiment 4

Figure 11:
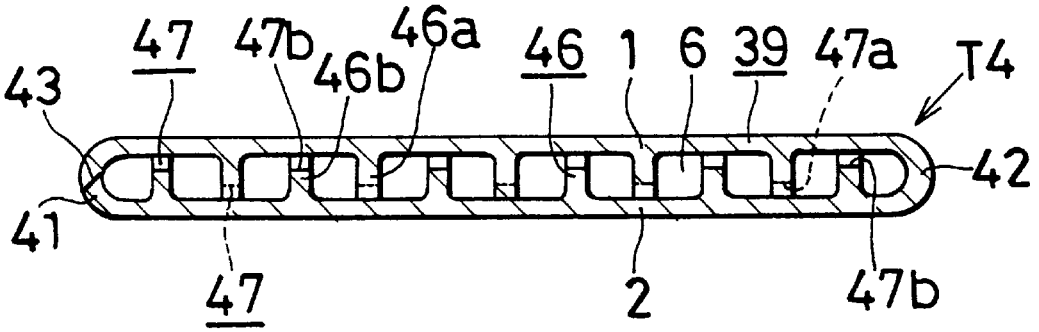
FIG. 11 is a cross sectional view of a flat refrigerant tube according to Embodiment 4 of the invention.

FIG. 11 shows this embodiment, i.e., a heat exchange refrigerant tube T4, which has two kinds of reinforcing walls 46. The walls 46 of one kind are each formed by a downward ridge 46*a* inwardly projecting from an upper wall 1 and joined to a flat inner surface of a lower wall 2. The walls 46 of the other kind are each formed by an upward ridge 46*b* inwardly projecting from the lower wall 2 and joined to a flat inner surface of the upper wall 1. The two kinds of walls 46 are arranged alternately. Trapezoidal communication holes 47 are formed by trapezoidal cutouts 47*a*, 47*b* provided respectively in the lower edge of the downward ridge 46*a* and in the upper edge of the upward ridge 46*b* and have their openings closed by one of the upper and lower walls 1, 2. With the exception of this feature, the present embodiment is the same as Embodiment 3.

Embodiment 5

Figure 12:
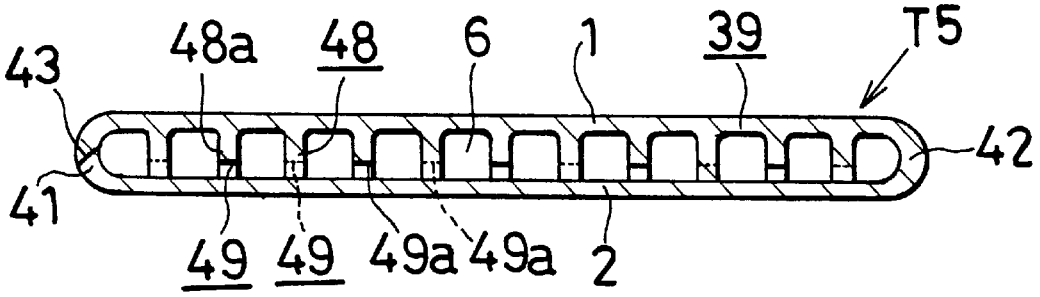
FIG. 12 is a cross sectional view of a flat refrigerant tube according to Embodiment 5 of the invention.

FIG. 12 shows this embodiment, i.e., a heat exchanger refrigerant tube T5. The tube T5 has reinforcing walls 48 which are formed by downward ridges 48*a* inwardly projecting from an upper wall 1 and joined to a flat inner surface of a lower wall 2. Trapezoidal communication holes 49 are formed by providing trapezoidal cutouts 49*a* in the lower edges of the ridges 48*a* at a predetermined spacing and closing the openings of the cutouts 49*a* with the lower wall 2. The present embodiment is the same as Embodiment 3 except for this feature.

Embodiment 6

Figure 13:
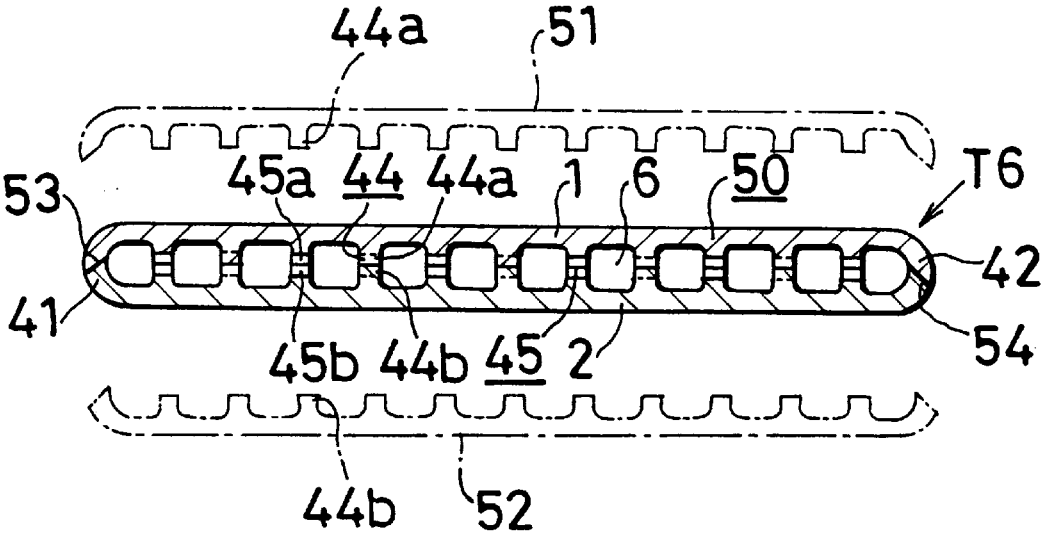
FIG. 13 is a cross sectional view of a flat refrigerant tube according to Embodiment 6 of the invention.

FIG. 13 shows this embodiment, i.e., a heat exchange refrigerant tube T4, which comprises a flat aluminum tube 50. The tube 50 is prepared from upper and lower two aluminum sheets 51, 53 by bending opposite side edges of the sheets to an arcuate shape toward each other so as to form a hollow portion, butting the sheets against each other edge to edge and joining the butted edges. Except for this feature, the present embodiment is the same as Embodiment 3. The left and right butt joints 53, 54 are oblique in cross section as is the case with Embodiment 3.

The aluminum sheet having the ridges, etc. and used in the foregoing embodiments can be replaced by an aluminum extrudate of specified cross section.

Examples of the invention will be described below along with a comparative example. The refrigerant tubes of the examples and comparative example are so shaped as shown in FIG. 1 in cross section.

EXAMPLE 1

A refrigerant tube which is 508 mm in length, 16.5 mm in the distance between side walls 3, 4, 1 mm in the height between upper and lower walls 1, 2, six in the number of reinforcing walls 5, 2.4 mm in the pitch of reinforcing walls 5, 0.3 mm in the thickness of reinforcing walls 5, 1.6 mm in the pitch P of communication holes 8, 0.8 mm in the length L of communication holes 8, 0.2 mm in the height H of communication holes 8, and 10% in opening ratio.

EXAMPLE 2

The same refrigerant tube as that of Example 1 except that this tube is 0.4 mm in the height of communication holes and 20% in opening ratio.

EXAMPLE 3

The same refrigerant tube as that of Example 1 except that the tube is 0.6 mm in the height of communication holes and 30% in opening ratio.

EXAMPLE 4

The same refrigerant tube as that of Example 1 except that the tube is 0.8 mm in the height of communication holes and 40% in opening ratio.

COMPARATIVE EXAMPLE

The same refrigerant tube as that of Example 1 except that the tube has no communication holes in the reinforcing walls.

Evaluation Test 1

The refrigerant tubes of Example 1 and Comparative Example were used to determine the relationship between the average quality X of refrigerant (the fraction of vapor mass in refrigerant) and the thermal conductance hA (h: heat transfer coefficient, A: the area of heat transfer surface inside the refrigerant tube). The method of determination was as follows. The refrigerant tube was placed in a cooling water channel, a refrigerant comprising HFC134a was passed through the tube, and cooling water was passed through the channel. After the lapse of a specified period of time, the mass velocity G of the refrigerant was set at 400 $kg/m^2 \cdot s$, the refrigerant inlet temperature at 650° C., and the heat flux between the refrigerant and the cooling water at 8 $kW/m_2$. The flow rate of the cooling water was so set as to give a Reynolds number of 1500. The thermal conductance hA was measured at varying values of average quality X.

Figure 14:
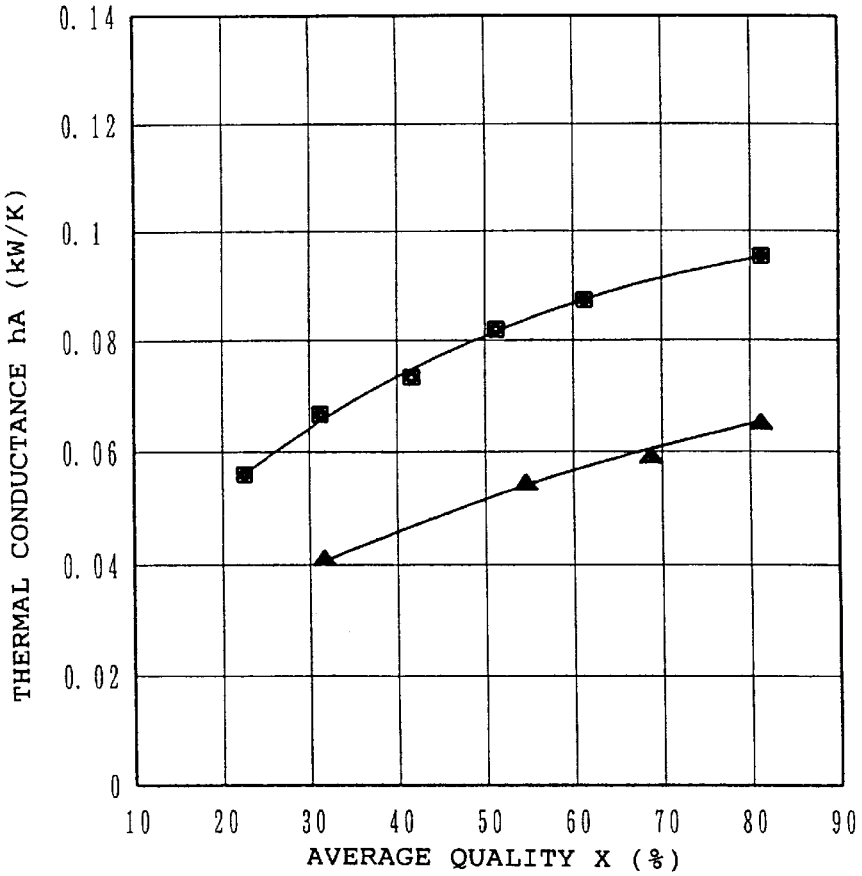
FIG. 14 is a graph showing the result of Evaluation Test 1, i.e., the relationship between the average quality X of refrigerant and the thermal conductance hA.

The result is shown in FIG. 14, which reveals that when the reinforcing walls are formed with communication holes, the thermal conductance hA is greater at any value of average quality X than when no holes are formed.

Evaluation Test 2

Figure 15:
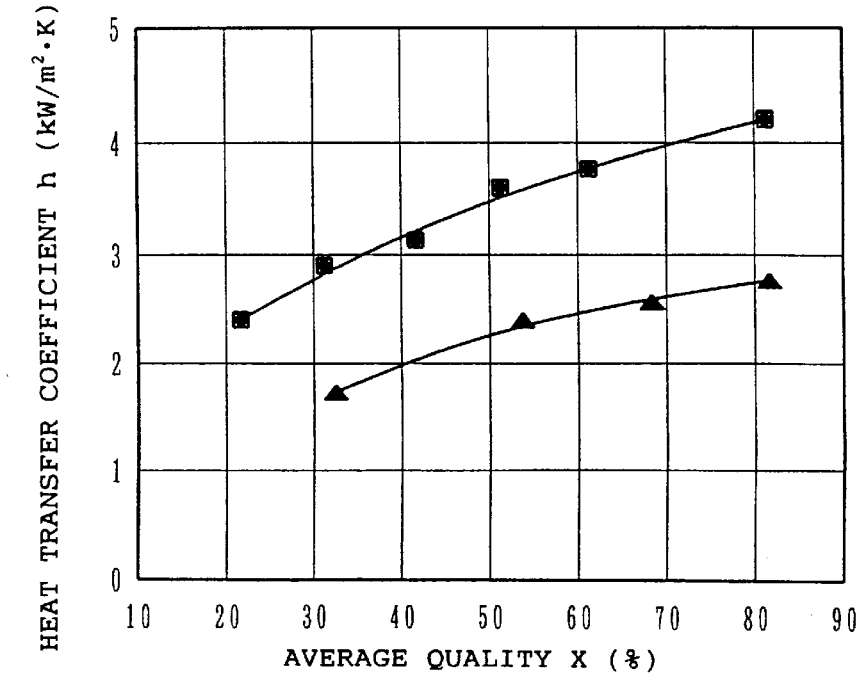
FIG. 15 is a graph showing the result of Evaluation Test 2, i.e., the relationship between the average quality X of refrigerant and the heat transfer coefficient h.

The refrigerant tubes of Example 2 and Comparative Example were used to determine the relationship between the average quality X of refrigerant and the heat transfer coefficient h by the same method as in Evaluation Test 1. FIG. 15 shows the result.

FIG. 15 reveals that at any value of average quality X, the heat transfer coefficient h is greater when the reinforcing walls are formed with communication holes than when no holes are formed.

Evaluation Test 3

Figure 16:
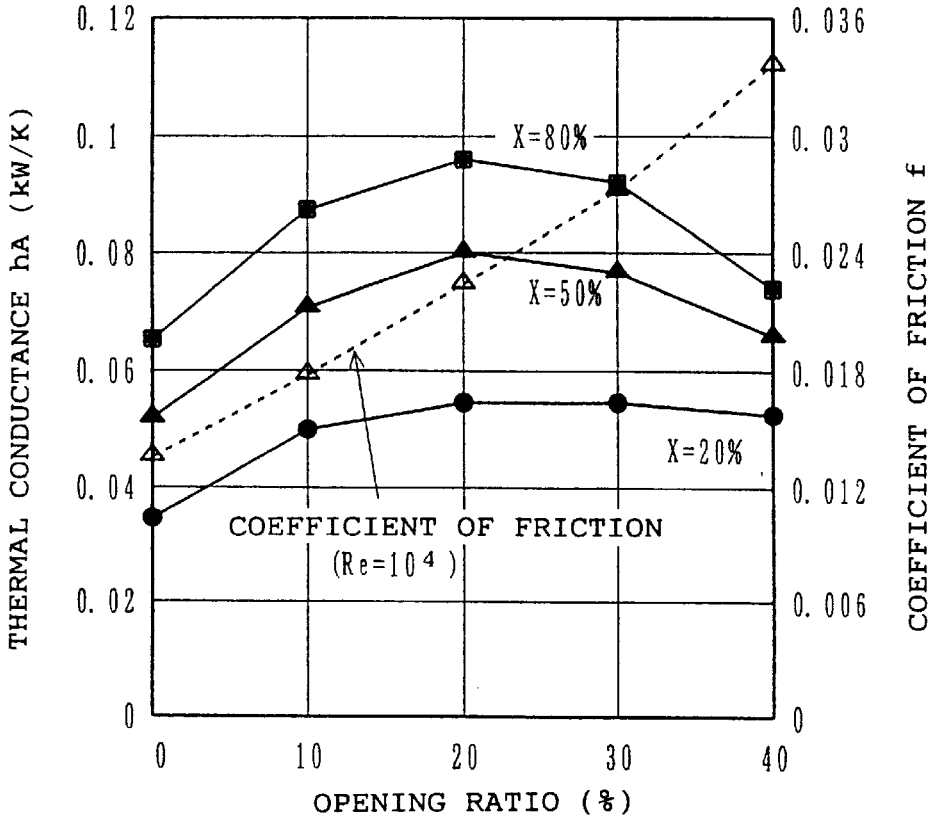
FIG. 16 is a graph showing the result of Evaluation Test 3, i.e., the relationship between the opening ratio and the thermal conductance hA at an average quality X of refrigerant of 20%, 50% or 80%, and the relationship between the opening ratio and the coefficient of friction f when the average quality X of refrigerant is 50%.

The refrigerant tubes of Examples 1 to 4 and Comparative Example were used to determine the relationship between the opening ratio and the thermal conductance hA at an average quality X of refrigerant of 20%, 50% or 80%, and the relationship between the opening ratio and the coefficient of friction f when the average quality X of refrigerant was 50% (Reynolds number of refrigerant: $10^4$), the relationships being determined by the same method as in Evaluation Test 1. FIG. 16 shows the result.

FIG. 16 indicates that at any value of average quality X, the thermal conductance hA is greater when the reinforcing walls are formed with communication holes than when no holes are formed, and that the thermal conductance hA is especially great at an opening ratio of 20%.

Evaluation Test 4

Figure 17:
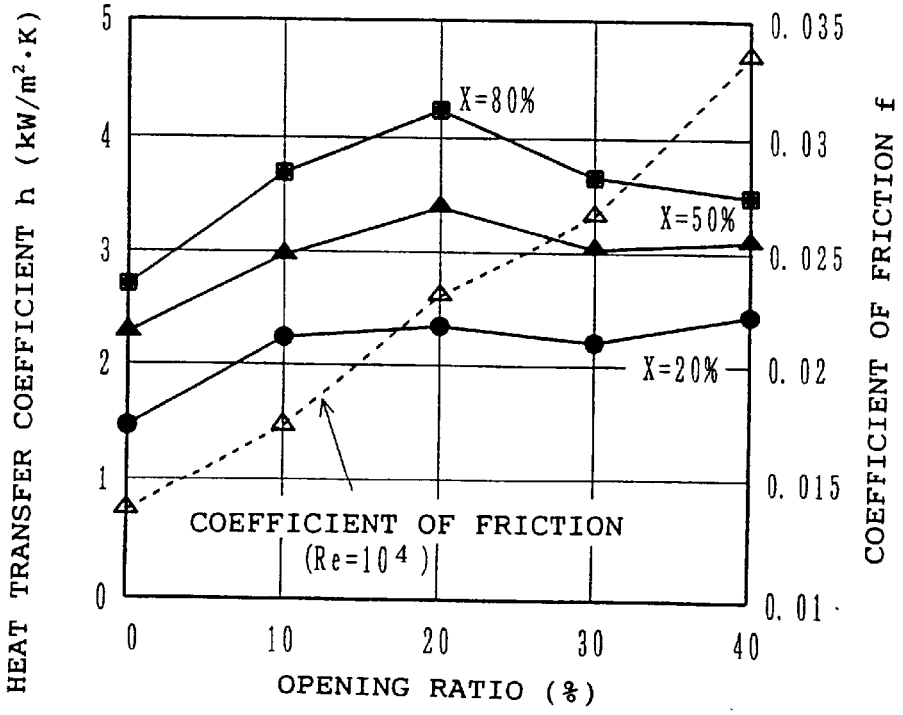
FIG. 17 is a graph showing the result of Evaluation Test 4, i.e., the relationship between the opening ratio and the heat transfer coefficient h at an average quality X of refrigerant of 20%, 50% or 80%, and the relationship between the opening ratio and the coefficient of friction f when the average quality X of refrigerant is 50%.

The refrigerant tubes of Examples 1 to 4 and Comparative Example were used to determine, by the same method as in Evaluation Test 1, the relationship between the opening ratio and the heat transfer coefficient h at an average quality X of refrigerant of 20%, 50% or 80%, and the relationship between the opening ratio and the coefficient of friction f when the average quality X of refrigerant was 50% (Reynolds number: $10_4$). FIG. 17 shows the result.

FIG. 17 indicates that at any value of average quality X, the heat transfer coefficient h is greater when the reinforcing walls are formed with communication holes than when no holes are formed, and that the heat transfer coefficient h is especially great at an opening ratio of 20%.

Evaluation Test 5

Figure 18:
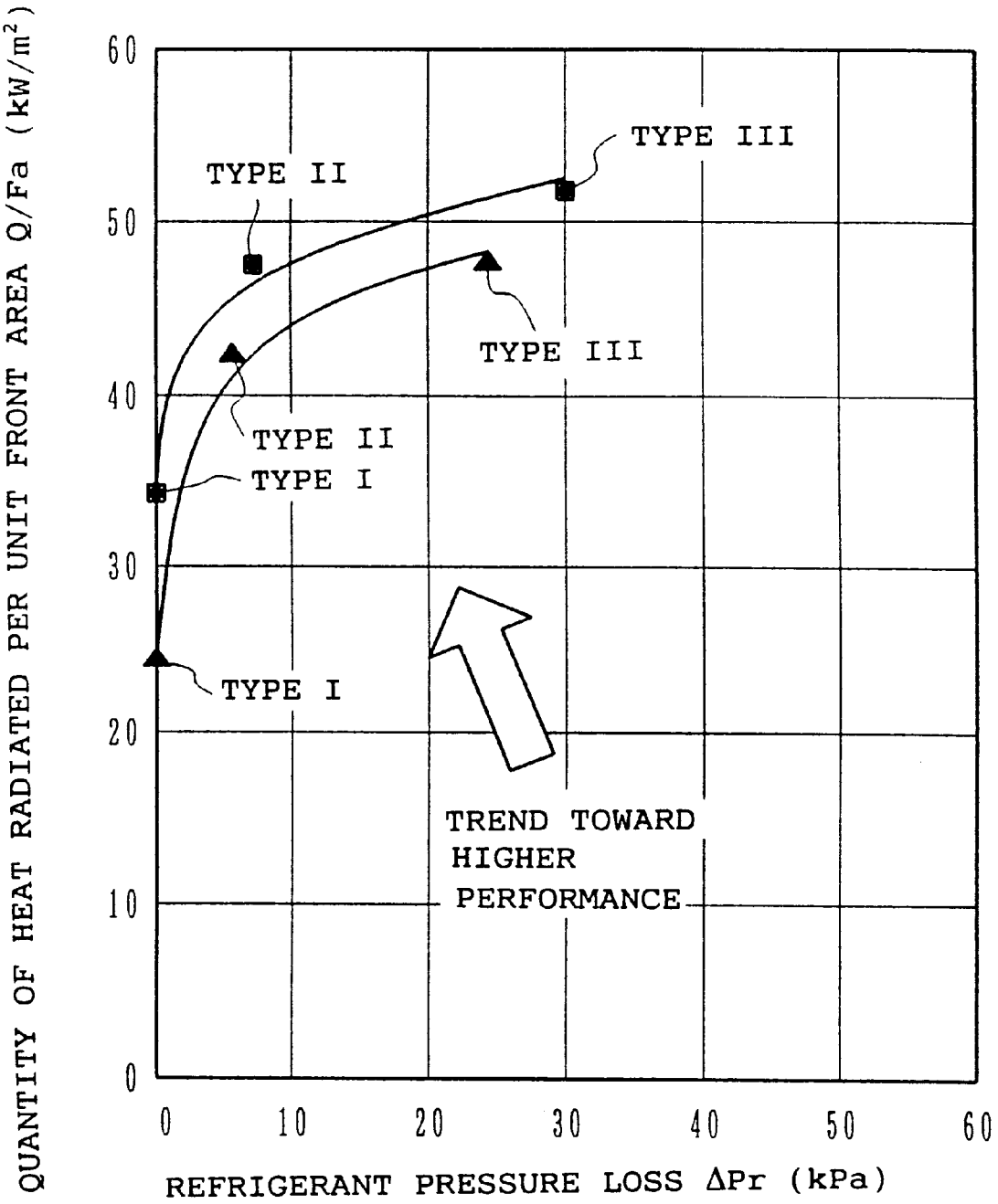
FIG. 18 is a graph showing the result of Evaluation Test 5, i.e., the relationship between the refrigerant pressure loss ΔPr and the quantity of heat radiated through unit front area, Q/Fa, as established for condensers comprising refrigerant tubes.

Three kinds of condensers of the multiflow type shown in FIG. 19 were fabricated using the refrigerant tube of Example 2 or Comparative Example. More specifically, 37 refrigerant tubes, and corrugated fins, 22 mm in width, 7 mm in height and 1 mm in fin pitch, were used for making a core portion measuring 326 mm in width, 330.5 mm in height and 0.108 $m^2$ in front area, and opposite ends of each tube were connected to right and left headers. No partition was provided in opposite headers in the condenser of the type I (single pass). The condenser of the type II had a partition inside the left header above the midportion thereof, another partition inside the right header below the midportion thereof, 20 refrigerant tubes positioned above the partition of the left header, 11 refrigerant tubes arranged between the two partitions, and 6 refrigerant tubes positioned below the partition of the tight header (three passes). The condenser of the type III had two partitions positioned respectively in an upper portion and a lower portion of the left header, two partitions positioned inside the right header, one at an intermediate level between the two partitions of the left header and the other at a level below the lower partition of the left header, 12 refrigerant tubes positioned above the upper partition of the left header, 9 refrigerant tubes between the upper partition of the left header and the upper partition of the right header, 7 refrigerant tubes positioned between the upper partition of the right header and the lower partition of the left header, 5 refrigerant tubes positioned between the lower partition of the left header and the lower partition of the right header, and 4 refrigerant tubes positioned below the lower partition of the right header (five passes). The condensers were checked for the relationship between the refrigerant pressure loss $\Delta Pr$ and the quantity of heat radiated per unit front area, Q/Fa. FIG. 18 shows the result.

FIG. 18 shows that the capacitor comprising the refrigerant tube wherein the reinforcing walls are formed with communication holes at an opening ratio of 20% exhibits an improved performance over the condenser comprising the refrigerant tube having no communication holes in the reinforcing walls and achieves an improvement even when the pressure loss is the same.

What is claimed is:

1. A heat exchanger refrigerant tube comprising a flat aluminum tube having parallel refrigerant passages and comprising upper and lower walls and a plurality of reinforcing walls connected between the upper and lower walls, the reinforcing walls extending longitudinally of the tube and spaced apart from one another by a predetermined distance, the flat aluminum tube being formed by joining upper and lower aluminum sheets so as to define a hollow portion by the two aluminum sheets, the reinforcing walls being formed by a ridge projecting inward from one of the upper and lower walls integrally therewith and joined to a flat inner surface of the other wall, the reinforcing walls being each formed with a plurality of communication holes for causing the parallel refrigerant passages to communicate with one another therethrough, the communication holes are formed by cutouts formed in an edge of the ridge at a predetermined spacing and having their openings closed by the other wall, each of the reinforcing walls being 10 to 40% in opening ratio which is the proportion of an area of all the communication holes in the reinforcing wall to a surface area of the reinforcing wall.

2. A heat exchanger refrigerant tube as defined in claim 1 wherein the opening ratio is 10 to 30%.

3. A heat exchanger refrigerant tube as defined in claim 1 wherein the opening ratio is about 20%.

4. A heat exchanger refrigerant tube as defined in claim 1, 2 or 3 wherein the communication holes are rectangular or trapezoidal in shape.

5. A heat exchanger refrigerant tube as defined in claim 1, 2 or 3 wherein the communication holes formed in the plurality of reinforcing walls are in a staggered arrangement relative to an adjacent reinforcing wall.

6. A heat exchanger refrigerant tube as defined in claim 1, wherein the aluminum sheets comprise a brazing sheet having a brazing filler metal layer over at least one of opposite surfaces thereof.

* * * * *